United States Patent [19]

Bell

[11] Patent Number: 4,787,366

[45] Date of Patent: Nov. 29, 1988

[54] SAFETY DEVICE FOR A HEARTH

[76] Inventor: Bobbi B. Bell, P.O. Box 993, Burgaw, N.C. 28425

[21] Appl. No.: 60,004

[22] Filed: Jun. 9, 1987

[51] Int. Cl.[4] ..... F24B 13/02

[52] U.S. Cl. ..... 126/500; 52/3; 428/74; 428/99; 5/493

[58] Field of Search ..... 126/57, 143, 201, 203, 126/202, 277, 278; 237/79; 428/74, 99, 100; 52/3, 515, DIG. 13; 5/100, 512, 493

[56] References Cited

U.S. PATENT DOCUMENTS

| | | | |
|---|---|---|---|
| 2,233,864 | 3/1941 | Edson | 5/493 |
| 2,245,779 | 6/1941 | Heil | 5/493 |
| 2,619,658 | 12/1952 | Weinberg | 5/493 |
| 3,368,601 | 2/1968 | Gantert-Merz | 5/493 |
| 3,430,272 | 3/1969 | Thorn | 5/100 X |
| 3,959,854 | 6/1976 | Lewis | 24/84 B |
| 4,094,021 | 6/1978 | Rapp | 52/3 X |
| 4,627,363 | 12/1986 | Jones | 52/3 X |
| 4,647,487 | 3/1987 | O'Neill | 428/100 X |

FOREIGN PATENT DOCUMENTS

| | | | |
|---|---|---|---|
| 519741 | 3/1955 | Italy | 428/74 |
| 323317 | 1/1930 | United Kingdom | 428/74 |
| 369010 | 3/1932 | United Kingdom | 126/201 |
| 410917 | 5/1934 | United Kingdom | 126/203 |
| 545890 | 6/1942 | United Kingdom | 428/74 |
| 795742 | 5/1958 | United Kingdom | 5/427 |

*Primary Examiner*—Margaret A. Focarino

*Attorney, Agent, or Firm*—Shlesinger, Arkwright & Garvey

[57] ABSTRACT

A safety device for an elevated hearth comprises a pad member substantially spanning the hearth to which the safety device is to be attached and for thereby substantially covering the vertical surfaces thereof. A fabric cover is secured to and disposed exterior of the pad member. An elastic band is secured to the cover for drawing the cover about the hearth. Velcro fasteners are attached to the cover and to the hearth for releasably securing the two together.

21 Claims, 2 Drawing Sheets

SAFETY DEVICE FOR A HEARTH

BACKGROUND OF THE INVENTION

A hearth is the brick, stone or tiled floor of a fireplace which extends out into a room. Generally, the fireplace is positioned within a vertical wall of the room. It is also common for the hearth to be elevated, thereby presenting sharp contact edges which could injure a child, or anyone else who might suddenly come into contact therewith.

A fireplace now frequently serves a decorative function in the home, although increased use of the fireplace for heating has recently been in vogue. The decorative aspect of the fireplace, as well as of its related hearth, therefore means that any additions thereto must likewise blend into the decoration scheme of the room. Many rooms containing a fireplace are decorated in the Early American motif, and any addition to the fireplace or hearth should likewise build upon this motif.

Small children will frequently engage in relatively rowdy play. It is not unheard of for one child to push another, thereby causing the other to fall. Should this rowdy play occur in proximity to the elevated fireplace hearth, then the possibility of injury can be clearly foreseen. Generally, the fireplace hearth is in the family room, also the room in which the children will normally play.

In view of the above, it can be seen that there is a need for a safety device which minimizes the possibility of injury occurring from an individual striking an elevated fireplace hearth. Furthermore, this safety device should be capable of blending into the motif of the room. The disclosed invention provides just such a safety device, and one which can be readily adapted for any fireplace hearth, regardless of size.

OBJECTS AND SUMMARY OF THE INVENTION

The primary object of the disclosed invention is a safety device for a fireplace hearth which minimizes the possibility of injury due to sudden impact with the hearth, as well as one which blends into the motif of the room in which the fireplace is positioned.

A safety device according to the invention is, preferably, used in cooperation with an elevated fireplace hearth. The device comprises padding means for substantially spanning the length of the hearth to which the device is to be attached, and for substantially covering the exposed vertical surfaces thereof. In this way, all sharp contact corners are covered. A fabric cover is secured to and disposed exteriorly of the padding means and is, preferably, of a pattern or style blending in with the motif of the room. A resilient bias means is operably connected to the cover and draws the cover about the hearth. The cover also has means for removably securing the cover to the hearth, which means cooperate with the bias means for maintaining the device about the hearth.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
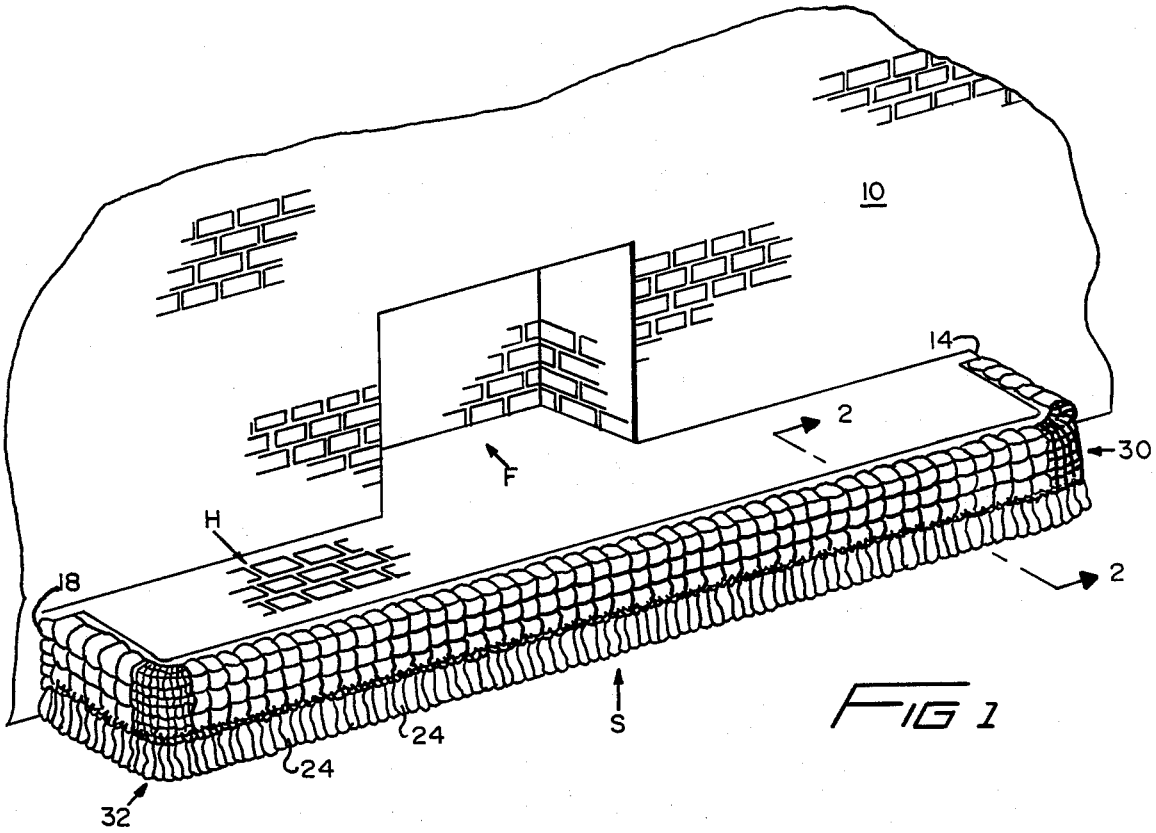
FIG. 1 is a fragmentary perspective view illustrating a fireplace and a hearth to which the safety device of the invention has been attached.

Fireplace F, as best shown in FIG. 1, is disposed within brick wall 10. The fireplace F is of conventional design, well known to those skilled in the art, and no further explanation is believed necessary. While I have illustrated the fireplace F as being located within a vertical brick wall 10, those skilled in the art will understand that the wall 10 could be comprised of some other material, either natural or synthetic, such as stone or the like, or the fireplace could be of the freestanding type.

Figure 2:
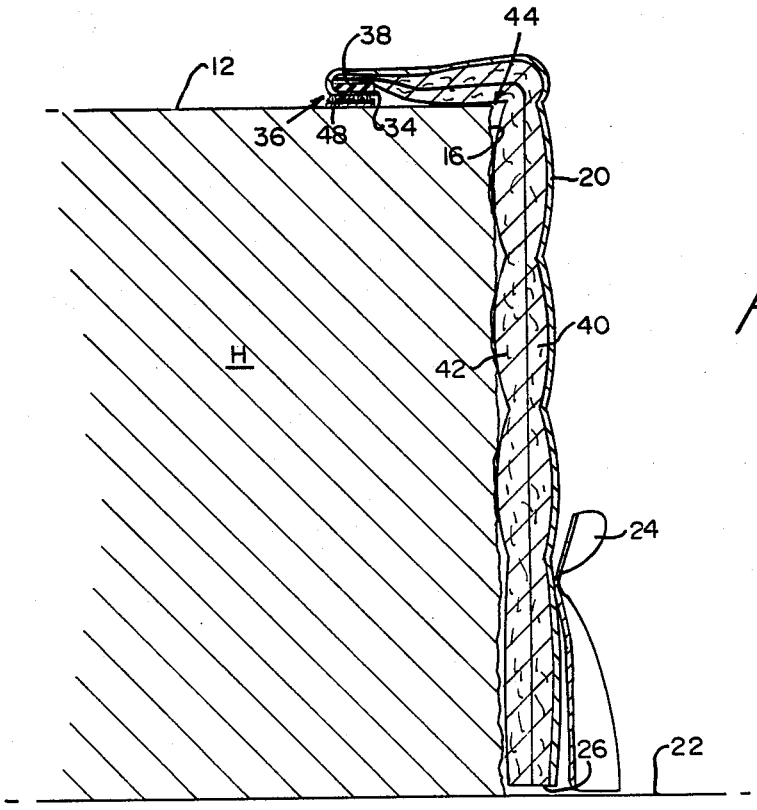
FIG. 2 is a fragmentary cross-sectional view taken along the section 2—2 of FIG. 1 and viewed in the direction of the arrows.

Hearth H, as best shown in FIGS. 1 and 2, extends from fireplace F and brick wall 10. The hearth H has a generally horizontal surface 12 extending transverse to brick wall 10. The hearth H and its elevated horizontal surface 12 are illustrated in FIG. 1 as being rectangular and thereby provide vertical surfaces 14, 16 and 18. Naturally, the hearth H could be of some other contour. The surfaces 14 and 18 extend outwardly from wall 10, generally transverse thereto, and the surface 16 extends parallel to the wall 10. While I have illustrated the surface 12 as terminating in a sharp corner with the surfaces 14, 16 and 18, those skilled in the art will understand that it is not uncommon for a hearth, such as hearth H, to have a ledge protruding beyond the associated vertical surfaces of the underlying support. This ledge, not illustrated, will likewise produce a sharp corner which may be protected by the safety device of the invention.

Safety device S, as best shown in FIG. 1, is disposed about vertical surfaces 14, 16 and 18 and overlying adjacent contiguous portions of horizontal surface 12. Safety device S includes an outer fabric cover 20, as best shown in FIG. 2, which runs from horizontal surface 12 and terminates just short of floor 22. The fabric cover 20 may be decorated with a fabric ruffle 24, preferably secured to the cover 20 proximate bottom edge 26. The ruffle 24 runs along the bottom edge 26 the length of the surfaces 14, 16 and 18 and also extends upwardly at the terminus thereof along the surfaces 14 and 18. The fabric 20 is, preferably, selected to match the decor of the room in which the fireplace F is positioned, and the ruffle 24 may therefore be omitted or be of a type other than that illustrated.

Figure 3:
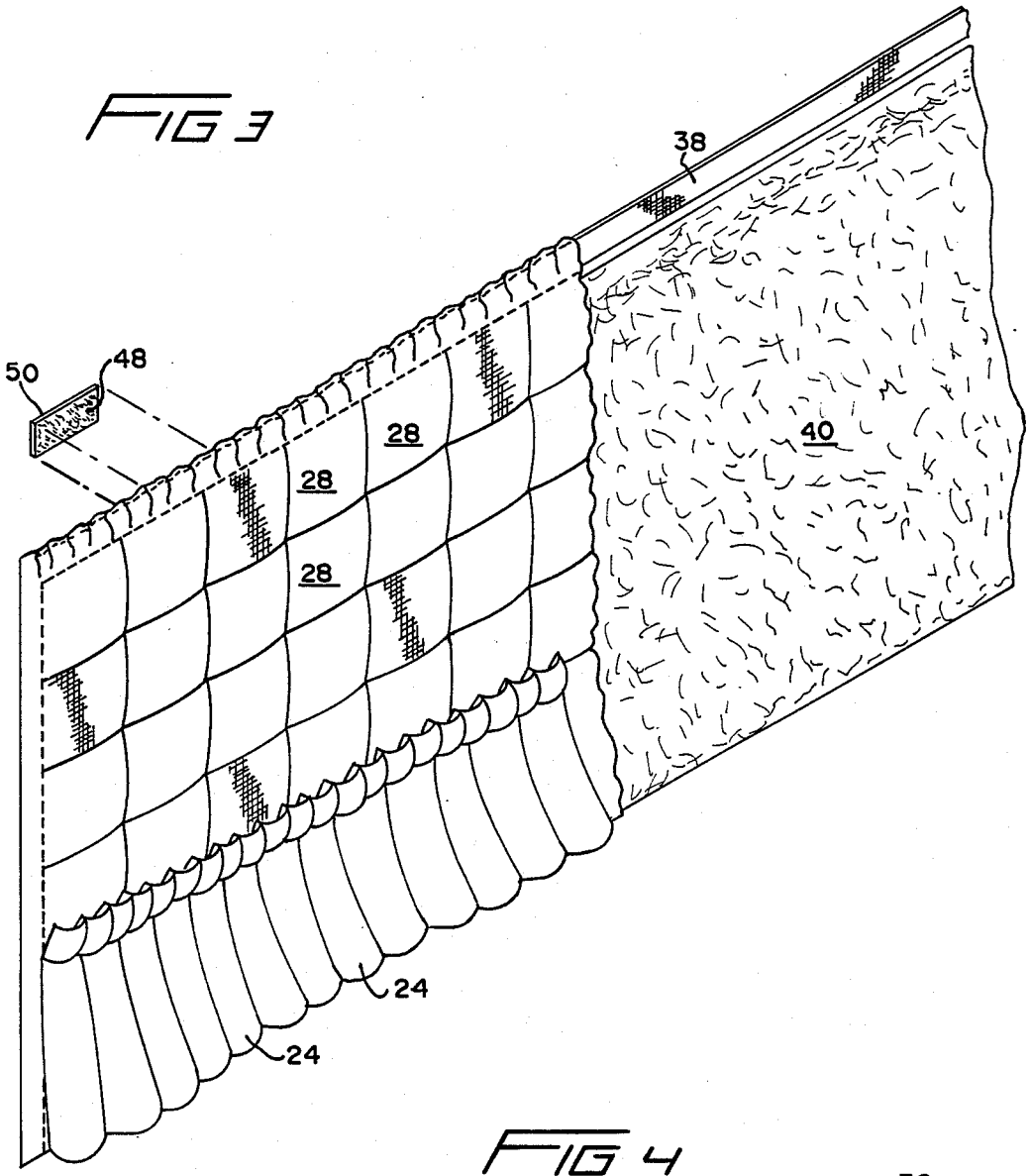
FIG. 3 is a fragmentary front elevational view of the safety device of the invention with portions broken away for clarity; and, FIG. 4 is a fragmentary rear elevational view of the safety device of the invention.

It can be noted in FIGS. 1 and 3 that the cover 20 has a quilted appearance. This is because the cover 20 is defined by a plurality of interconnected fabric panels 28 which are stitched together by a means well known to those skilled in the art. The quilted-together fabric panels 28 increase the protection provided by the device S, as will be further explained.

The interconnected fabric panels 28 are formed into a corner form at 30 and 32, as best shown in FIG. 1, in order to provide increased protection in the area of the vertical corners provided by the interconnection of the surfaces 14 and 16, as well as of the surfaces 16 and 18. It can be seen in FIG. 4 that the corner forms 30 and 32 have substantial length in order to permit the cover 20 to extend around the resulting corners of the hearth H.

The cover 20 has a folded over element 34 which is stitched to the overlying portion of cover 20 in order to provide a band portion 36 of apertured configuration. Elastic band 38 runs through band portion 36 and is secured at the ends thereof by stitching or the like. The elastic band 38 cooperates with the band portion 36 of cover 20 to draw the cover 20 about the vertical surfaces 14, 16 and 18. This helps to maintain the safety device S in its position about the hearth H.

Pad members 40 and 42 are secured together in face-to-face relation interior of cover 20 and contiguous with surfaces 12, 14, 16 and 18. Each of the pad members 40 and 42 has a portion sandwiched between the elastic band 38 and the overlying cover portion, to which they are stitched, in order to secure the pad members 40 and 42 to the cover 20. In this way, each of the pad members 40 and 42 extends from band portion 36 to edge 26 and thereby provides a padded arrangement of a quilted nature which minimizes the possibility of injury should an individual impact corner 44, as best shown in FIG. 2, or some other vertical or horizontal corner of the hearth H. The pad members 40 and 42 may be stitched to the overlying exterior fabric panels 28 in order to further help to maintain the pad member 40 and 42 in proper position, and to further assure the quilted nature.

The pad members 40 and 42 are, preferably, comprised of batting. Those skilled in the art will understand that batting is a material, either synthetic or natural, which is manufactured in sheets and is used for making quilts. I have found that a particularly good batting is manufactured from polyester fiber and may be purchased from Barnhardt Mfg. Co. under their designation POLY 600. Those skilled in the art will understand that other batting materials may be used, and may also be used in single thickness in appropriate instances.

Figure 4:
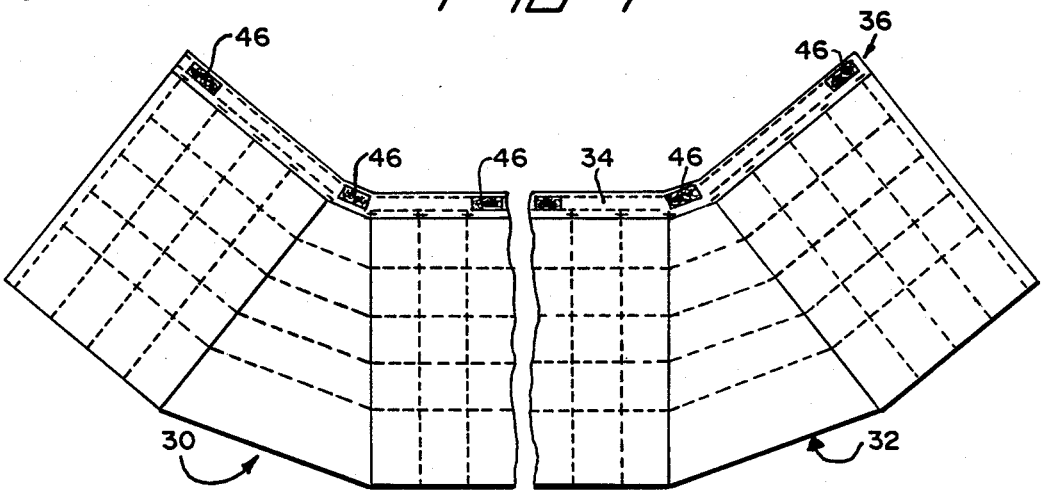

FIGS. 2–3 disclose the Velcro® fasteners which I use to help maintain the safety device S in firm securement to horizontal surface 12, and about hearth H. Preferably, a plurality of first securement elements 46 are secured to folded over element 34, as best shown in FIG. 4. Naturally, each of the elements 46 requires a cooperating second securement element 48, only one of which is shown in FIG. 3, although those skilled in the art will understand that each element 46 has its own cooperating element 48. The securement elements 48 each, preferably, have an adhesive coated surface 50 so that the elements 48 may be secured to the horizontal surface 12. In this way, I further insure that the safety device S maintains its position about the hearth H. Furthermore, because the elements 48 can be adhesively positioned to the surface 12, then they may be appropriately located by the use with regard to the contour of the surface 12.

The surfaces 14, 16 and 18, preferably and usually, have a textured or roughened exterior, as best shown in FIG. 2. Such a textured exterior is normally provided by brick, concrete and the like, materials frequently used to provide the underlying base or foundation for the hearth H, or for the horizontal surface 12. The pad members 40 and 42, being comprised of polyester fiber batting, have a filamentary amorphous structure. This filamentary amorphous structure frictionally engages or clings to the textured exterior vertical surfaces. The frictional engagement between the pad member 42 and the vertical surfaces 14, 16 and 18 is sufficient to help maintain the pad member 40 and 42 in appropriate vertical orientation should the Velcro® fasteners 46 and 48 become detached, or should they not even be used. It should be recalled that the elastic band 38 draws the cover 20 about the vertical surfaces, so that the band 38 cooperates with the filamentary amorphous structure of the pad members 40 and 42 in a way which helps maintain the padded structure of the device S about the hearth H.

FIG. 4 illustrates the stitching, in dotted line, which is used for securing the fabric panels 28 together, as well as the corner forms 30 and 32. Also illustrated in dotted line is the stitching which defines the band portion 36, through which the elastic band 38 is run.

While this invention has been described as having a preferred design, it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

What I claim is:

1. Safety device for use with an elevated hearth or the like having horizontal and vertical surfaces, comprising:

(a) padding means for substantially spanning the length of a hearth to which the safety device is to be attached and having a first portion for substantially covering the vertical surfaces thereof and a second portion for overlying at least a portion of a horizontal hearth surface;

(b) cover means secured to and exterior of said padding means;

(c) resilient biasing means carried by said second portion and substantially spanning said cover means for drawing said cover means about the hearth; and, (d) means for removably securing said cover means to the hearth.

2. The device of claim 1, wherein (a) said padding means being comprised of a filamentary amorphous material providing a textured surface for frictionally securing said padding means to the vertical surfaces of the hearth.

3. The device of claim 2, wherein (a) said padding means including first and second pad members, said pad members being secured together in face-to-face relation.

4. The device of claim 3, wherein (a) each of said pad members being comprised of synthetic batting.

5. The device of claim 1, wherein (a) said biasing means including an elastic band.

6. The device of claim 1, wherein (a) said cover means comprised of fabric and having a folded over portion defining a band portion;

(b) said biasing means running through said band portion; and, (c) said securing means extending from said band portion.

7. The device of claim 6, wherein:

(a) said padding means including first and second pad members disposed in face to face relation; and (b) each of said pad members having a portion positioned within said band portion for thereby securing said pad members together and to said cover means.

8. The device of claim 6, wherein:

(a) said securing means including first and second securement elements; and, (b) one of said elements being secured to said band portion and the other of said elements including means for securement to the hearth and said elements adapted for being removably secured together.

9. The device of claim 8, wherein (a) said securement means including an adhesive substantially covering a surface of said other element.

10. The device of claim 7, wherein:

(a) said cover means including first and second vertically spaced edge portions; and, (b) said band portion extending along and defining one of said edge portions and a fabric ruffle being secured proximate the other of said edge portions.

11. Improved fireplace assembly, comprising:

(a) an elevated hearth extending from a fireplace and including at least one vertical and one contiguous horizontal surface;

(b) padding means substantially spanning said vertical surface and covering an adjacent portion of said horizontal surface;

(c) cover means secured to and disposed exterior of said padding means;

(d) bias means operably connected to said cover means for drawing said cover means about said vertical surface; and, (e) means for removably securing said padding means to one of said surfaces.

12. The assembly of claim 11, wherein:

(a) said vertical surface being interrupted; and, (b) said padding means comprised of a filamentary amorphous material providing a textured surface adapted to cling to said interrupted vertical surface.

13. The assembly of claim 12, wherein:

(a) said padding means comprising first and second pad members, said members being secured together in face-to-face relation; and, (b) each of said members comprised of a synthetic batting.

14. The device of claim 11, wherein:

(a) said bias means comprising an elastic band.

15. The assembly of claim 14, wherein:

(a) said cover means being folded over and providing an apertured band portion; and, (b) said elastic band extending through said band portion.

16. The assembly of claim 15, wherein:

(a) said band portion having a first element contiguous with said horizontal surface and said padding means having a portion thereof sandwiched between said first element and an overlying portion of said cover means for thereby securing said cover means to said padding means.

17. The assembly of claim 16, wherein:

(a) said securing means including a first securement element secured to said first element and a second securement element secured to said horizontal surface, said securement elements being releasably secured together.

18. The assembly of claim 17, wherein:

(a) means adhesively securing said second securement element to said horizontal surface.

19. The assembly of claim 17, wherein:

(a) said band portion extending along a first edge of said cover means; and, (b) a fabric ruffle being removably secured to said cover means adjacent a second edge of said cover means.

20. The assembly of claim 19, wherein:

(a) said hearth having first, second and third vertical surfaces, said first and third surfaces extending from said fireplace and generally transverse to said second surface;

(b) said padding means substantially spanning said first, second and third surfaces; and, (c) said cover means covering said first, second and third surfaces.

21. Safety device for use with an elevated hearth or the like having vertical surfaces, comprising:

(a) padding means for substantially spanning a hearth to which the safety device is to be attached and for substantially covering the vertical surfaces thereof, said padding means comprised of a filamentary amorphous material providing a textured surface for frictionally securing said padding means to the vertical surfaces of the hearth when the device is attached thereto;

(b) cover means secured to and exterior of said padding means;

(c) resilient biasing means operably connected to said cover means for drawing said cover means about the vertical surfaces; and, (d) means for removably securing said cover means to the hearth.

* * * * *